United States Patent [19]

Kirisawa

[11] 4,313,450

[45] Feb. 2, 1982

[54] COIN-DISPENSING DEVICE

[75] Inventor: Noriaki Kirisawa, Kawasaki, Japan

[73] Assignee: Fuji Electric Co., Ltd., Kanagawa, Japan

[21] Appl. No.: 106,270

[22] Filed: Dec. 21, 1979

[51] Int. Cl.[3] ..... G07D 1/00

[52] U.S. Cl. ..... 133/5 R; 133/4 A

[58] Field of Search ..... 133/2, 4 R, 4 A, 5 R; 221/129, 275

[56] References Cited

U.S. PATENT DOCUMENTS 2,634,846 4/1953 Arashiro et al. ..... 133/2 X 3,102,663 9/1963 Albright ..... 221/275

FOREIGN PATENT DOCUMENTS 394951 12/1933 United Kingdom ..... 133/2

*Primary Examiner*—F. J. Bartuska

*Attorney, Agent, or Firm*—Rogers, Eilers & Howell

[57] ABSTRACT

A coin-dispensing device has a coin reservoir, a coin-dispensing slide that is disposed adjacent to said coin reservoir and that is movable relative to said coin reservoir to dispense coins from that coin reservoir, an eccentric that is disposed adjacent to at least a portion of that coin-dispensing slide and that is movable relative to and with that coin-dispensing slide, a driving element for that eccentric and an abutment on that eccentric and an abutment on that portion of that coin-dispensing slide which are selectively engageable in response to relative movement of that eccentric and of that portion of that coin-dispensing slide toward each other and which are selectively separable in response to relative movement of that eccentric and of that portion of that coin-dispensing slide away from each other. The engagement of those abutments will coact with movement of that eccentric by the driving element to cause movement of the coin-dispensing slide relative to the coin reservoir, and hence will effect the dispensing of a coin.

15 Claims, 12 Drawing Figures

FIG. 5.
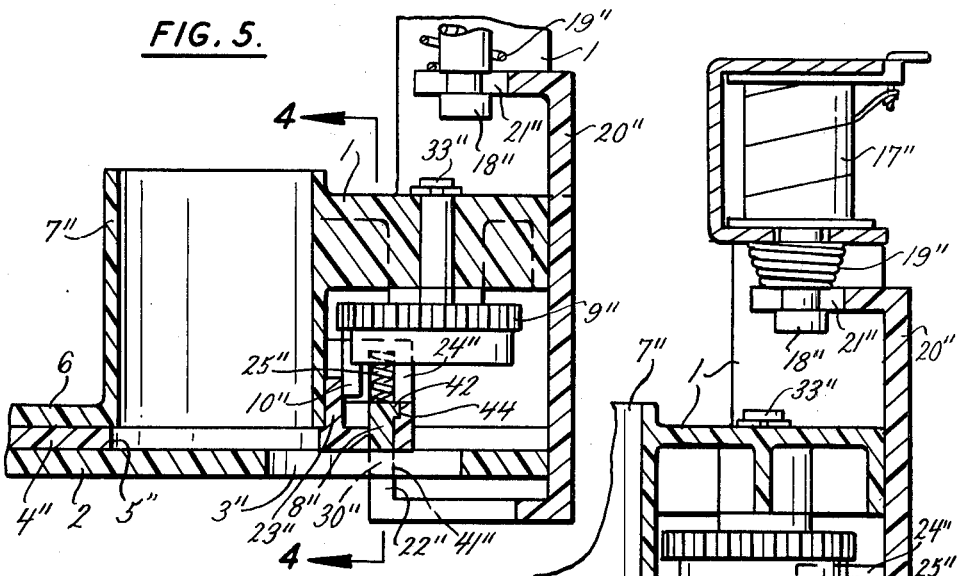
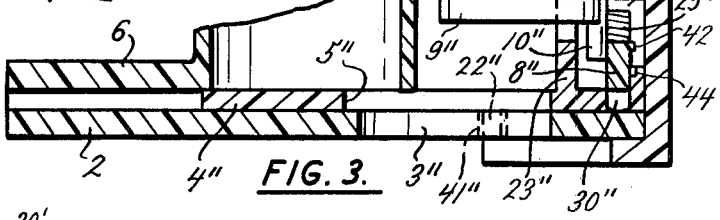
FIG. 3.
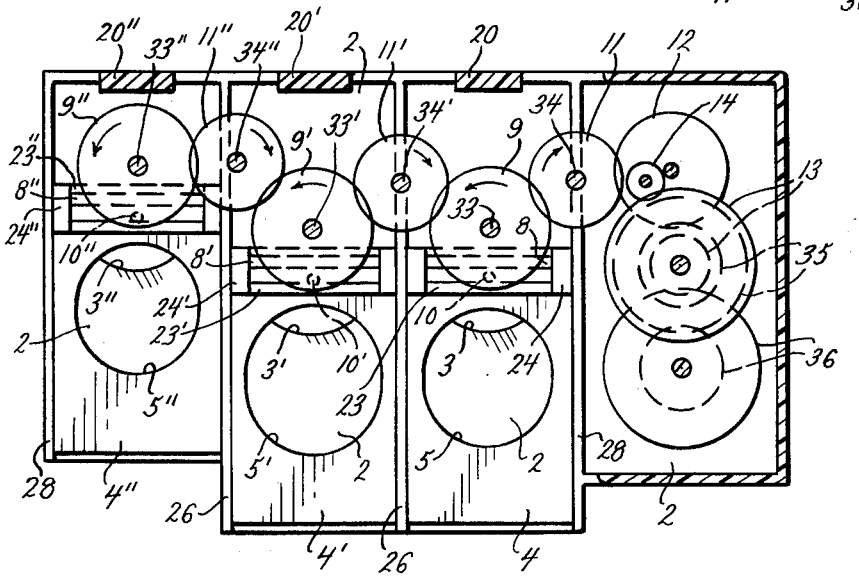
FIG. 2.

COIN-DISPENSING DEVICE

BACKGROUND OF THE INVENTION

Coin-dispensing devices frequently include coin reservoirs, coin-dispensing slides adjacent those coin reservoirs, and solenoids that selectively drive those coin-dispensing slides relative to those coin reservoirs to dispense coins from those coin reservoirs. In some instances the electro-dynamic characteristics of the solenoids can cause those solenoids to apply forces to those coin-dispensing slides which are objectionable.

SUMMARY OF THE INVENTION

The present invention provides a coin-dispensing device which has a number of coin reservoirs, a coin-dispensing slide adjacent each of those coin reservoirs, an eccentric adjacent each of those coin-dispensing slides which is movable relative to at least a portion of that coin-dispensing slide and also is movable with that portion of that coin-dispensing slide to effect movement of that coin-dispensing slide relative to that coin reservoir. A motor rotates those eccentrics and thereby provides desirable electro-dynamic characteristics for the driving of those coin-dispensing slides. Abutments on those eccentrics and on those portions of those coin-dispensing slides are movable relative to each other by solenoids to selectively permit a desired one of those coin-dispensing slides to be driven by the eccentric therefor. It is, therefore, an object of the present invention to provide a coin-dispensing device which has a coin reservoir, a coin-dispensing slide adjacent that coin reservoir, an eccentric adjacent that coin-dispensing slide which is movable relative to at least a portion of that coin-dispensing slide to effect movement of that coin-dispensing slide relative to that coin reservoir, and a motor which rotates that eccentric to drive that coin-dispensing slide.

The coin-dispensing device of the present invention is usable with an automatic coin-operated vending machine. That coin-dispensing device is equipped with vertical coin reservoirs for storage of each kind of coin; and slide plate elements adjacent those coin reservoirs are adapted to slide back and forth below those coin reservoirs to an outlet of that automatic coin-operated vending machine. To dispense a coin, a lever is moved to raise a gate plate on a slide plate element into the path of a pin-like cam on a cam disc which is driven by a motor; and that motor will then drive that slide plate element far enough to transfer a coin from the adjacent coin reservoir to the outlet of the automatic coin-operated vending machine. The lever is selectively moved by a solenoid from a normal position wherein it permits the gate plate to be out of the path of the pin-like cam to a moved position wherein that gate plate is in the path of that cam. As a result, the slide plate elements normally are at rest and only a selected one of those slide plate elements need be moved by the motor at any given time; and hence a relatively small motor can be used. It is, therefore, an object of the present invention to provide a coin-dispensing device for use with an automatic coin-operated vending machine wherein slide plate elements normally remain at rest and only selected ones of those slide plate elements are driven by an electric motor to effect the transfer of coins from coin reservoirs to an outlet of that automatic coin-operated vending machine.

Other and further objects and advantages of the present invention should become apparent from an examination of the drawing and accompanying description.

In the drawing and accompanying description, a preferred embodiment of the present invention is shown and described but it is to be understood that the drawing and accompanying description are for the purpose of illustration only and do not limit the invention and that the invention will be defined by the appended claims.

BRIEF DESCRIPTION OF THE DRAWING

FIG. 2 is a sectional plan view showing the relation between slide plate elements and cam discs and gears which are used in the device of FIG. 1, FIG. 3 is a vertical section, on a larger scale, showing one of the slide plate elements, one of the cam discs, one of the levers, and one of the solenoids of the device of FIG. 1, FIG. 5 is a vertical section that is similar to, and is on the same scale as, the vertical section of FIG. 3, but it shows different positions of the slide plate element, cam disc, lever and solenoid plunger.

DETAILED DESCRIPTION OF THE PREFERRED EMBODIMENT

Figure 4:
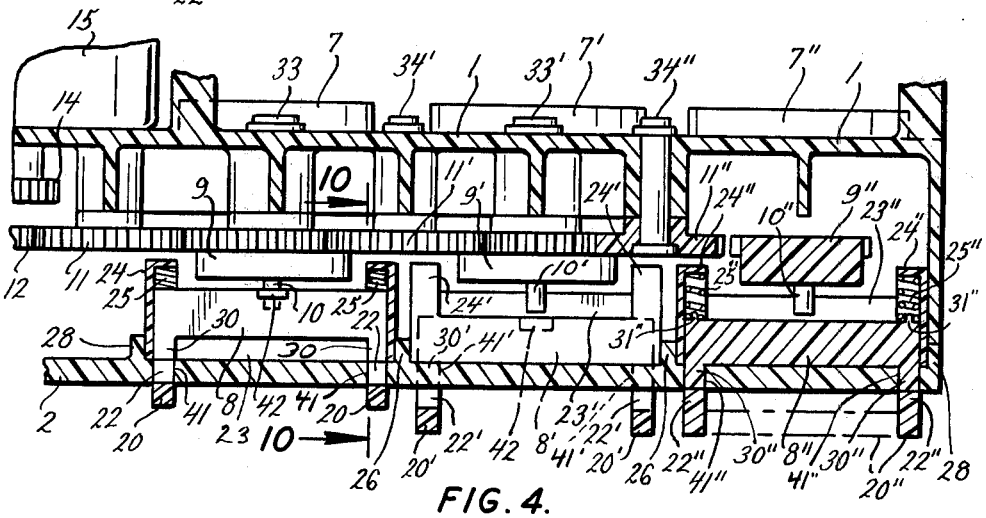
FIG. 4 is a vertical section, on a scale close to that of FIG. 3, which is taken along spaced planes close to the line 4—4 in FIG. 5.

In FIGS. 1 to 10, the same parts or portions are indicated by the same numerals. Thus, 1 denotes an L-shaped housing, 2 denotes a lower plate for that housing, 3, 3' and 3'' denote coin-releasing holes in that lower plate, 4, 4' and 4'' denote slide plate elements, 5, 5' and 5'' denote holes in those slide plate elements, 6 denotes a plate which is disposed a short distance above that lower plate, 7, 7' and 7'' denote coin tubes or reservoirs, 8, 8' and 8'' denote gate plates movably mounted on the slide plate elements, 9, 9' and 9'' denote cam discs, 10, 10' and 10'' denote eccentric actuating pins, 11, 11' and 11'' denote idler gears, 15 denotes an electric motor, 17, 17' and 17'' denote solenoids, 18 and 18'' denote the plungers of solenoids 17 and 17'', 19 and 19'' denote helical compression springs for the plungers 17 and 17'', 20, 20' and 20'' denote C-shaped levers, 22, 22' and 22″ denote pairs of actuating projections on the levers 20, 20′ and 20″, 23, 23′ and 23″ denote rectangular walled recesses on the slide plate elements, 24, 24′ and 24″ denote hollow side walls of the rectangular walled recesses of the slide plate elements, and 25 and 25″ denote helical compression springs within the hollow side walls 24 and 24″. Openings 41, 41′ and 41″ are provided in the lower plate, 2; and those openings are arranged in pairs, as indicated by FIG. 4.

Figure 1:
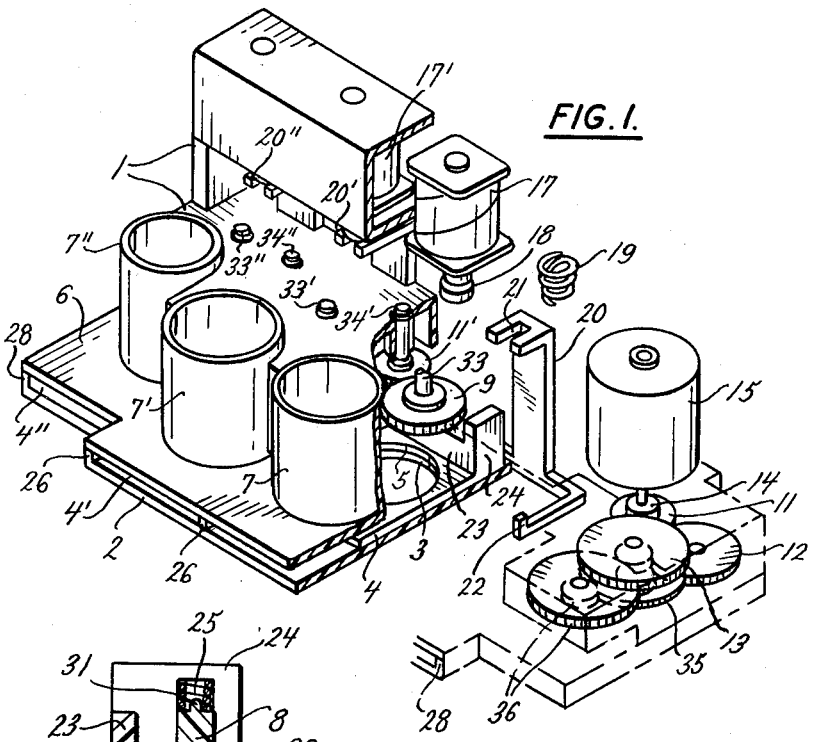
FIG. 1 is an exploded perspective view that shows a coin-dispensing device which is made according to the present invention.

The L-shaped housing 1 is underlain by the upper and lower plates 6 and 2; and those plates project beyond the left-hand edge of that housing in FIGS. 1, 3 and 5. The slide plate elements 4, 4′ and 4″ are sandwiched between the upper and lower plates 6 and 2; and spacers 26 are interposed between those slide plate elements. Those spacers coact with guides 28 to confine and guide the slide plate member 4, 4′ and 4″, while holding those slide plate members in spaced-apart relation. The upper plate 6 is equipped with the three vertical coin reservoirs 7, 7′ and 7″ which temporarily store three different kinds of coins. The lower ends of those coin reservoirs are concentric with holes in the plate 6, as indicated by FIGS. 3 and 5, so coins may pass downwardly into those holes from those reservoirs. The three holes 3, 3′ and 3″ in the lower plate 2 correspond to, but are displaced laterally from, the holes which are in the upper plate 6 at the lower ends of coin reservoirs 7, 7′ and 7″. The holes 3, 3′ and 3″ in the lower plate 2 permit coins to pass through them and thence to the outlet of the automatic coin-operated vending machine; so coins can be delivered to patrons of that automatic coin-operated vending machine. The holes 3, 3′ and 3″ of the lower plate 2 are large enough to receive coins from the holes 5, 5′ and 5″ in the slide plate elements 4, 4′ and 4″. The holes 5, 5′ and 5″ of those slide plate elements are normally positioned below, and in register with, the corresponding holes in the upper plate 6; so each of the former holes can receive and hold a coin from the corresponding coin reservoir 7, 7′ or 7″. Subsequently, when a hole 5, 5′ or 5″ is moved into position wherein it is in register, and coextensive, with the corresponding hole 3, 3′ or 3″ of lower plate 2, the former hole will allow the coin therein to fall down through the latter hole and move toward the outlet of the automatic coin-operated vending machine. The upper and lower plates 6 and 2 are suitably secured to the L-shaped housing 1.

Figure 10:
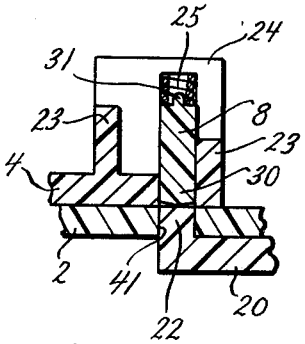
FIG. 10 is a sectional view on a still larger scale, and it is taken along the plane indicated by the line 10—10 in FIG. 4.

The rectangular walled recess 23 of the slide plate element 4 has a front wall which is higher than the rear wall thereof, as shown particularly by FIG. 10. Similarly, the front walls of the rectangular walled recesses 23′ and 23″ of the slide plate elements 4′ and 4″, respectively, are higher than the rear walls of those rectangular walled recesses. The side walls 24, 24′ and 24″ of the rectangular walled recesses 23, 23′ and 23″ have vertically-directed grooves therein which confine and guide the sides of the movable gate plates 8, 8′ and 8″. Those vertically-directed grooves confine those gate plates for vertical movement; and they also confine the helical compression springs 25 and 25″ plus a helical compression spring, not shown, for the gate plate 8′. The lower ends of those helical compression springs telescope over upwardly-extending projections 31 and 31″ at the ends of gate plates 8 and 8″ and over counterpart projections at the ends of the plate 8′. Those springs tend to hold the gate plates 8, 8′ and 8″ in lower positions such as those occupied by gate plate 8′ in FIG. 4 and by gate plate 8″ in FIGS. 4 and 5. However, those springs can yield to permit those gate plates to be moved to upper positions such as those occupied by gate plate 8 in FIGS. 4 and 10 and by gate plate 8″ in FIG. 3. Each gate plate 8, 8′ and 8″ has an abutment 42 at the rear face thereof which is engageable with a socket 44 in the front surface of the rear wall of the adjacent rectangular walled recess 23, 23′ or 23″ to limit downward movement of that gate plate.

The pairs of openings 41, 41′ and 41″, which are in the lower plate 2, are located below, and in register with, the vertically-directed grooves in the side walls 24, 24′ and 24″ of the rectangular walled recesses 23, 23′ and 23″ of slide plate elements 4, 4′ and 4″; and hence the openings of those pairs of openings are located at the opposite sides of the slide plate elements 4, 4′ and 4″. Those openings accommodate downwardly-directed projections 30, 30′ and 30″ at the ends of the lower faces of gate plates 8, 8′ and 8″, respectively, whenever those gate plates are in their lower positions. Those openings will accommodate the pairs of actuating projections 22, 22′ and 22″ on the C-shaped levers 20, 20′ and 20″, respectively, whenever those levers are in raised positions, such as those occupied by lever 20 in FIGS. 4 and 10 and by lever 20″ in FIG. 3. Whenever the solenoids 17, 17′ and 17″ are de-energized, the helical compression springs 19 and 19″ and their counterpart for solenoid 17′ will hold the actuating projections 22, 22′ and 22″ below the levels of the pairs of openings 41, 41′ and 41″, respectively; and hence the projections 30, 30′ and 30″ on gate plates 8, 8′ and 8″ will be held within those pairs of openings by the helical compression springs 25 and 25″ and their counterparts for gate plate 8′. At such time, those projections will prevent movement of any of the slide plate elements 4, 4′ and 4″ relative to the lower plate 2.

As indicated by FIGS. 1 and 4, pivots 33, 33′ and 33″ for the cam discs 9, 9′ and 9″, respectively, extend upwardly through the top of the L-shaped housing 1. C-washers engage annular grooves in the upper ends of those pivots and bear against the upper surface of that L-shaped housing to hold those pivots against downward movement. As indicated particularly by FIGS. 3–5, the eccentric actuating pins 10, 10′ and 10″ extend downwardly from the lower faces of the cam discs 9, 9′ and 9″, respectively. As indicated by FIGS. 3–5, the lower ends of those eccentric actuating pins always are located below the levels of the upper edges of the front walls of the rectangular walled recesses 23, 23′ and 23″. As indicated by FIGS. 2, 5, 6 and 9, those lower ends normally abut the rear faces of those front walls. As indicated by FIGS. 3 and 5, the lower ends of the eccentric actuating pins 10, 10′ and 10″ always are located above the levels of the upper edges of the rear walls of the rectangular walled recesses 23, 23′ and 23″. As indicated by FIGS. 3–5, those lower ends are located above the levels of the upper edges of the gate plates 8, 8′ and 8″ whenever those gate plates are in their lower positions, but will be located below the level of the upper edge of each gate plate that is in its raised position. This means that as long as those gate plates are left in their normal lower positions, the cam discs 9, 9′ and 9″ can rotate the eccentric cam pins 10, 10′ and 10″ through complete revolutions without moving any of the slide plate elements 4, 4′ and 4″ out of the positions of FIG. 2; because the lower ends of those pins will move over, and not engage, the upper edges of those gate plates and the upper edges of the rear walls of the rectangular walled recesses 23, 23′ and 23″. However, when any of the gate plates 8, 8′ and 8″ is raised to its upper position, as indicated by FIG. 3, the lower end of the adjacent eccentric pin 10, 10' or 10'' will respond to the rotation of its supporting cam disc 9, 9' or 9'' to move the adjacent slide plate element 4, 4' or 4'' from the position of FIG. 5 to the position of FIG. 3. That movement will enable the hole 5, 5' or 5'' in that slide plate element to move a coin into register with the appropriate opening 3, 3' or 3'' in the lower plate 2; and that coin will then fall downwardly through that opening and pass to the outlet of the automatic coin-operated vending machine.

The cam discs 9, 9' and 9'' are made as gears with smooth, reduced-diameter, lower skirts and with the eccentric pins 10, 10' and 10'' extending below, and also projecting radially outwardly of, those skirts. Those cam discs are caused to rotate simultaneously by idler gears 11, 11' and 11'' which are supported by pivots 34, 34' and 34''. As indicated by FIG. 2, all of the cam discs 9, 9' and 9'' rotate in the same direction; and, although such rotation is desirable, it is not absolutely essential. The motor 15 has a pinion 14 on the output shaft thereof; and that pinion operates through a speed-reducing gear train, which includes a gear 12, a gear 13 with an attached pinion, a gear 35 with an attached pinion, and a gear 36 with an attached pinion to drive the idler gear 11 in FIG. 2. The gears 13 and 35 are rotatable on the same pivot as indicated by FIG. 2; and the gear 13 is located above the gear 35, as indicated by FIG. 1. The pinion 14 drives gear 13, the attached pinion of gear 13 drives gear 36, the attached pinion of gear 36 drives gear 35, the attached pinion of gear 35 drives gear 12, and the latter gear drives idler gear 11. A "homing" switch, not shown, of standard and usual design, is mounted adjacent the gear 12; and that switch will coact with an abutment, not shown, on that gear to stop motor 15 after the gear train has caused gear 12 to make one revolution. The motor 15 has a dynamic brake, and hence will not tend to "coast". Although each of the cam discs 9, 9' and 9'' will respond to each energization of motor 15 to rotate its pin 10, 10' and 10'', respectively, through a complete revolution, only that slide plate element 4, 4' or 4'' which has had the gate plate 8, 8' or 8'' thereof raised up out of the normal lower position of FIG. 5 will be moved to the position of FIG. 3.

Referring particularly to FIGS. 1, 3 and 5, the solenoids 17, 17' and 17'' are mounted in the top of the L-shaped housing 1 so each slide plate element 4, 4' and 4'' has one of the solenoids 17, 17' and 17'' in register with it. The C-shaped levers 20, 20' and 20'' are secured to, and depend downwardly from, the plungers 18 and 18'' of solenoids 17 and 17'' and the counterpart plunger of solenoid 17'. Those plungers and levers are urged downwardly by the helical compression springs 19 and 19'' and by the counterpart spring for lever 20'. Each lever 20, 20' and 20'' has a notch 21, 21' and 21'', respectively, at the upper end thereof which accommodates an annular groove at the lower end of the solenoid plunger which corresponds to that lever. Also, each lever has horizontally-spaced legs which bear the actuating projections 22, 22' and 22'' at the upper faces of the outer ends thereof, as indicated by FIGS. 1 and 4. Those projections underlie, and are in register with, the downwardly-directed projections 30, 30' and 30'' at the ends of the gate plates 8, 8' and 8'' which normally are disposed within the pairs of openings 41, 41' and 41'' in the lower plate 2.

As long as the solenoids 17, 17' and 17'' are deenergized, the levers 20, 20' and 20'' and the actuating projections 22, 22' and 22'' will be in the normal lower positions indicated by FIG. 5; and hence they will permit the gate plates 8, 8' and 8'' to remain in their lower positions. However, when any of the solenoids 17, 17' and 17'' is energized, it will raise its plunger and the attached lever 20, 20' or 20''; and will thereby cause the actuating projections 22, 22' or 22'' on that lever to engage and raise the downwardly-directed projections 30, 30' or 30'' at the ends of the adjacent gate plate 8, 8' or 8''. The energization of motor 15 then will cause the adjacent cam disc 9, 9' or 9'' to move the lower end of its pin 10 into engagement with the upper edge of that gate plate, and thereby move that gate plate, and the slide plate element by which it is held, to the position of FIG. 3. The solenoid 17, 17' or 17'' must raise its plunger and the attached lever 20, 20' or 20'' far enough to raise the downwardly-directed projections 30, 30' or 30'' at the ends of that gate plate out of the openings 41, 41' or 41'' in the lower plate 2, as indicated by FIG. 3.

In the operation of the coin-dispensing device of the present invention, one of the solenoids 17, 17' and 17'' will be energized in response to a coin-dispensing signal; and the plunger of that solenoid will raise the attached lever 20, 20' or 20'' despite the biasing action of the corresponding spring 19, 19' or 19''. Very promptly, the motor 15 will receive a driving signal; and it will cause all of the cam discs 9, 9' and 9'' to rotate via the speed-reducing gear train and the idler gears 11, 11' and 11''. As the lever 20, 20' or 20'' is raised, the actuating projections 22, 22' or 22'' thereon will raise the adjacent gate plate 8, 8' or 8'' so the upper edge thereof is in the path of the adjacent pin 10, 10' or 10'' and so the projections 30, 30' or 30'' thereon are out of the openings 41, 41' or 41'' in the lower plate 2. After the cam discs 9, 9' and 9'' have rotated through the angle $\theta$ shown in FIG. 9, the pin 10, 10' or 10'' on the appropriate one of those cam discs will engage the upper edge of the raised gate plate 8, 8' or 8''; and continued rotation of that one cam disc will force the slide plate element, which confines that gate plate, to the position of FIG. 3. Thereupon, the coin within the hole 5, 5' or 5'' in that slide plate element will fall downwardly through the adjacent hole 3, 3' or 3'' in the lower plate 2.

The moved slide plate element will come to rest as the pin 10, 10' or 10'' reaches a position which is displaced one hundred and eighty degrees from its normal position; and that slide plate element will remain at rest until that pin moves through an angle equal to the angle $\theta$. Thereafter, that slide plate element will have the rear face of the front wall of the recess 23, 23' or 23'' thereof engaged by the pin 10, 10' or 10'', and that pin will move that slide plate element back to the position of FIG. 5. At that time, a further coin will move downwardy from the adjacent coin reservoir 7, 7' or 7'' and come to rest in the opening 5, 5' or 5'' in the slide plate element.

Although all of the three cam discs 9, 9' and 9'' rotate simultaneously, only one of them will move a slide plate element at any given time. Preferably, the coin-dispensing operation is carried out so any coins of the largest denomination are dispensed first and are dispensed one at a time. During the dispensing of the largest denomination coins, the cam discs 9 and 9'' corresponding to the smaller denomination coins will rotate but will not move the adjacent slide plate elements 4 and 4'' because the gate plates 8 and 8'' of those slide plate elements will not have been raised by the adjacent solenoids 17 and 17″. Preferably, any middle denomination coins which are to be dispensed will be dispensed before any small-denomination coins are dispensed. Importantly, at any given time, only one cam disc 9, 9′ or 9″ must drive an adjacent slide plate element; and hence a relatively small motor 15 can be used. Also, by permitting each pin 10, 10′ or 10″ to rotate through the angle $\theta$ before it must start driving the adjacent slide plate element 4, 4′ or 4″ toward the position of FIG. 3, and then permitting that pin to rotate through an angle of equal size before it must start driving that slide plate element back toward the position of FIG. 5, the present invention enables the motor 15 to be operating at full speed before the pin 10, 10′ or 10″ starts moving the adjacent slide plate element. In the drawing, one coin reservoir is shown for one hundred (100) yen coins, another coin reservoir is shown for fifty (50) yen coins, and the third coin reservoir is shown for ten (10) yen coins. However, those coin reservoirs could be dimensioned to accommodate coins of any desired value or national origin. Further, more or fewer coin reservoirs 7, 7′ or 7″, slide plate elements 4, 4′ and 4″, solenoids 17, 17′ and 17″ and levers 20, 20′ and 20″ can be provided.

As indicated hereinbefore, the motor 15 is provided with a dynamic brake; and that brake will be applied as soon as that motor is de-energized. Where that occurs, the cam discs 9, 9′ and 9″ will not "coast" after that motor is deenergized; and hence the eccentric pins 10, 10′ and 10″ on those cam discs will be in the positions shown by FIG. 2 whenever that motor is de-energized. At such time, the holes 5, 5′ and 5″ in the slide plate elements 4, 4′ and 4″ will underlie, and be in register with, the bottoms of the adjacent coin reservoirs 7, 7′ and 7″. Also at such time, those eccentric pins will be spaced far enough forwardly of the gate plates 8, 8′ and 8″ so the selected solenoids 17, 17′ and 17″ will be able to raise those gate plates into the paths of the eccentric pins 10, 10′ and 10″ on the cam discs 9, 9′ and 9″ even where those solenoids and the motor 15 are energized simultaneously.

To assure proper operation of the coin-dispensing device in the event the dynamic brake of the motor 15 failed to stop rotation of gear 12 at the instant that motor became de-energized, the gate plates 8, 8′ and 8″ are disposed far enough rearwardly of the front walls of the rectangular recesses 23, 23′ and 23″ to enable the eccentric pins 10, 10′ and 10″ to be spaced forwardly of those gate plates even if the gear 12 "coasted" after the motor 15 became de-energized. Consequently, even if that gear were to "coast", the slide plate elements 4, 4′ and 4″ would be in the positions of FIG. 2 prior to each coin-dispensing cycle of the coin-dispensing device. Also, to assure proper operation of the coin-dispensing device in the event the dynamic brake of the motor 15 failed to stop rotation of gear 12 at the instant that motor became de-energized, it is desirable to have solenoid 17, 17′ or 17″ energized a fraction of a second before the motor 15 is energized. Such energization is easily provided by standard and usual motor controlling circuitry.

The selected solenoids 17, 17′ and 17″ can be energized for periods of time which are shorter than the time required for the motor 15 to drive the cam discs 9, 9′ and 9″ through a single revolution. Specifically, after a selected solenoid 17, 17′ or 17″ has raised the adjacent gate plate 8, 8′ or 8″ to its raised position, and has held that gate plate in that position while the adjacent eccentric pin 10, 10′ or 10″ moves that gate plate, and the slide plate element 4, 4′ or 4″ therefore, to the position of FIG. 3, that solenoid can be de-energized. The continued rotation of that adjacent eccentric pin will cause that eccentric pin to move away from the gate plate 8, 8′ or 8″ and into engagement with the rear face of the front wall of the rectangular recess 23, 23′ or 23″, and then will cause that eccentric pin to drive the slide plate element 4, 4′ or 4″ back to the position of FIG. 5. Consequently, even though the selected solenoids 17, 17′ and 17″ could be energized and de-energized simultaneously with the motor 15, those selected solenoids will preferably be energized a fraction of a second before motor 15 is energized and will preferably be de-energized before that motor is de-energized.

Figure 6:
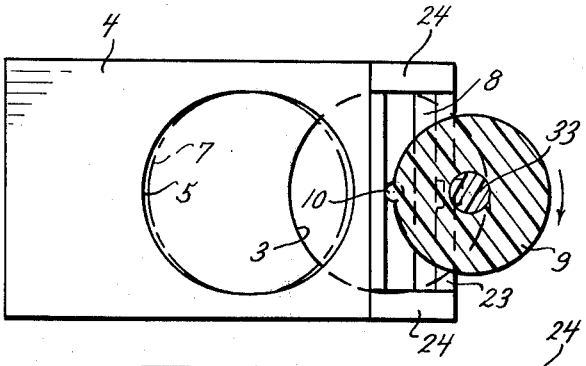
FIG. 6 is a sectional plan view of a slide plate element and cam disc therefor.
Figure 7:
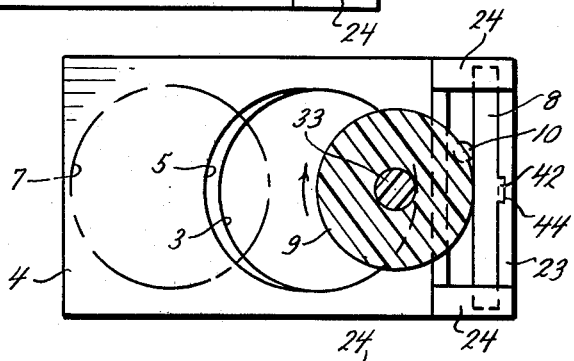
FIG. 7 is another sectional plan view of the slide plate element and cam disc of FIG. 6, but it shows that slide plate element close to its coin-releasing position.
Figure 8:
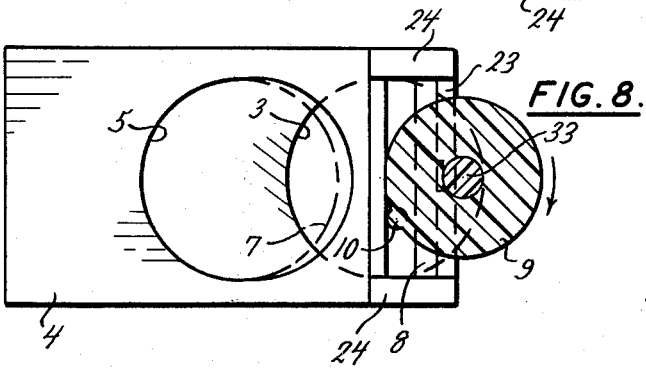
FIG. 8 is a further sectional plan view of the slide plate element and cam disc of FIG. 6, but it shows that slide plate element spaced a short distance away from the position of FIG. 6.

Referring particularly to FIGS. 6–8, the normal position of slide plate element 4 is shown by FIG. 6; and it will be noted that the eccentric pin 10 is immediately adjacent the rear face of the front wall of the recess 23 and is spaced forwardly of the front face of the gate plate 8. FIG. 7 shows the position of the slide plate element 4 as it approaches the position indicated by FIG. 3, wherein the opening 5 therein will move into register with the hole 3 in the lower plate 2 and wherein that slide plate element will momentarily come to rest. FIG. 8 shows the position of the slide plate element 4 after the eccentric pin 10 has moved away from the gate plate 8 and has moved into engagement with the rear face of the front wall of the recess 23 and has forced that wall to move back toward the position of FIG. 6.

It will be noted that no slide plate element 4, 4′ or 4″ is moved unless and until a coin of the denomination corresponding to that slide plate element must be dispensed. As a result, none of those slide plate elements is subjected to needless movement; and hence those slide plate elements experience minimal wear and have long lives. The cam discs 9, 9′ and 9″ all rotate whenever any slide plate element 4, 4′ or 4″ is required to move; but those cam discs are mounted for rotary movement and are amply lubricated, and hence also have long lives. Because the motor 15 need only drive one slide plate element 4, 4′ or 4″ at any given time, the instantaneous load on that motor always is low, and hence that motor also has a long life.

The downwardly-directed projections 30, 30′ and 30″ on the gate plates 8, 8′ and 8″ normally lock the slide plate elements 4, 4′ and 4″ against accidental movement. This is desirable; because it will keep persons, who might insert stiff wires or other elongated objects through the outlet of the automatic coin-operated vending machine, from effecting the dispensing of coins by moving any of those slide plate elements back and forth between the positions of FIGS. 5 and 3.

Figure 12:
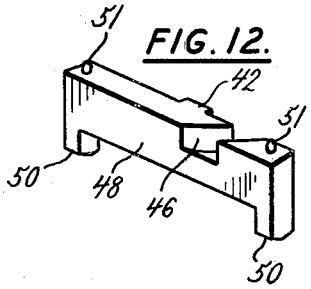
FIG. 12 is a front perspective view of the gate plate of the slide plate member of FIG. 11.
Figure 9:
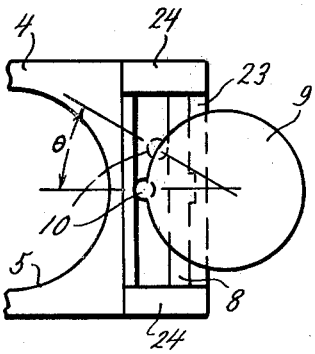
FIG. 9 is a kinematic plan view of two positions of the cam disc of FIG. 3 relative to the adjacent slide plate element.
Figure 11:
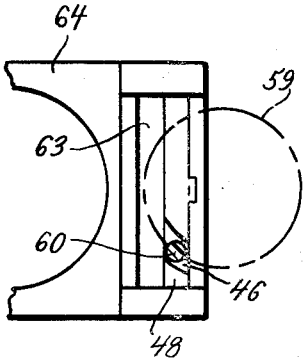
FIG. 11 is a kinematic plan view which shows an abutment on a cam disc of another coin-dispensing device moving through a notch on the gate plate of the slide plate member of that coin-dispensing device.

The upper edge of gate plate 48, for the other coin-dispensing device of FIGS. 11 and 12, has an arcuate slot or notch 46 therein. The upper edges of the other gate plates, not shown, for that coin-dispensing device have similar slots or notches therein. Each of those slots or notches is wide enough and deep enough to accommodate the eccentric pin 60 on the adjacent cam disc 59; even when that gate plate is in its raised position. That slot or notch is displaced from that portion of the upper edge of that gate plate which will be engaged by that eccentric pin during the movement of the adjacent slide plate element 64 from a position corresponding to that of FIG. 5 to a position corresponding to that of FIG. 3. As a result, that slot or notch will not permit that eccentric pin to escape from the rectangular walled recess 63 of that slide plate element as that slide plate element is moved to the position which corresponds to that of FIG. 3. The slots or notches 46 are provided to permit an eccentric pin 60, which somehow happens to be external of the rectangular walled recess 63 of the adjacent slide plate element, to enter that recess, even though the gate plate 48 of that slide plate element is in a raised position corresponding to that of FIG. 3. Specifically, if an eccentric pin 60 is initially spaced rearwardly of a raised gate plate 48, that pin will approach the rear face of that gate plate and pass freely through the notch 46 to enter the rectangular recess 63 rather than engage and injure, or be injured by, an un-notched upper edge of that gate plate. The walls of the slot or notch 46 have curvatures which enable the pins 60 to pass through them, as the cam discs 49 rotate in the clockwise direction and the slide plate element is in a position corresponding to that of FIG. 5. The gate plates 48 will be provided with pairs of projections 50 and 51 which can be identical to the pairs of projections 31 and 30 on the gate plates 8, 8' and 8''.

If desired, the upper edges of the gate plates 8, 8' and 8'' could be provided with slots or notches that were similar to the slot or notch 46. Those slots or notches would be dimensioned and located to enable the pins 10, 10' and 10'' to pass through them, as the cam discs 9, 9' and 9'' rotate in the clockwise direction and the slide plate elements are in positions corresponding to that of FIG. 5.

It will be noted that the solenoids 17, 17' and 17'' provide relative movement between the eccentric pins 10, 10' and 10'', on the cam discs 9, 9' and 9'', and the gate plates 8, 8' and 8'' of the slide plate elements 4, 4' and 4''; and also that those solenoids thereafter permit relative movement of those gate plates with those eccentric pins. As a result, each eccentric pin 10, 10' and 10'' constitutes a member which is movable relative to at least a portion 8, 8' and 8'' of each slide plate element, and which also is movable with that portion of that slide plate element to move that slide plate element.

Whereas the drawing and accompanying description have shown and described a preferred embodiment of the present invention, it should be apparent to those skilled in the art that various changes may be made in the form of the invention without affecting the scope thereof.

What is claimed is:

1. A coin-handling device which has a plurality of coin reservoirs, a plurality of coin-dispensing slides that are disposed adjacent to said coin reservoirs and that are movable relative to said coin reservoirs to dispense coins from said coin reservoirs, an electric motor, a plurality of rotatable slide-moving members that are disposed adjacent to said coin reservoirs and to said coin-dispensing slides therefor and that are connected to said electric motor so that all of said rotatable slide-moving members rotate whenever a coin is to be dispensed from any of said coin reservoirs, and means to provide relative movement to a selected one of said rotatable slide-moving members and of a portion of the adjacent coin-dispensing slide toward each other and away from each other, said selected one rotatable slide-moving member being movable with said portion of said adjacent coin-dispensing slide to move said adjacent coin-dispensing slide after said relative movement of said selected one rotatable slide-moving member and of said portion of said adjacent coin-dispensing slide toward each other, a driving element for said selected one rotatable slide-moving member which is intermediate said electric motor and said selected one rotatable slide-moving member, an abutment on said selected one rotatable slide-moving member that is positively forced into direct engagement with said portion of said adjacent coin-dispensing slide to directly move said portion of said adjacent coin-dispensing slide whenever said means provides said relative movement of said selected one rotatable slide-moving member and said portion of said adjacent coin-dispensing slide toward each other, said abutment on said selected one rotatable slide-moving member and said portion of said adjacent coin-dispensing slide being selectively but directly engageable in response to said relative movement of said selected one rotatable slide-moving member and of said portion of said adjacent coin-dispensing slide toward each other and being selectively separable in response to said relative movement of said selected one rotatable slide-moving member and of said portion of said adjacent coin-dispensing slide away from each other, the engagement of said abutment on said selected one rotatable slide-moving member and said portion of said adjacent coin-dispensing slide directly and positively enabling movement of said selected one rotatable slide-moving member to move said adjacent coin-dispensing slide.

2. A coin-handling device as claimed in claim 1 wherein said adjacent coin-dispensing slide has an area in which said abutment on said selected one rotatable slide-moving member should be disposed whenever said abutment on said selected one rotatable slide-moving member directly engages said portion of said adjacent coin-dispensing slide, and wherein said area has a gap which will permit said abutment on said selected one rotatable slide-moving member to enter said area even if said abutment on said selected one rotatable slide-moving member is initially displaced from said area.

3. A coin-handling device as claimed in claim 1 wherein a further abutment normally locks said adjacent coin-dispensing slide against movement, and wherein said further abutment moves to unlocked position during said relative movement of said selected one rotatable slide-moving member and of said portion of said adjacent coin-dispensing slide toward each other.

4. A coin-handling device as claimed in claim 1 wherein a further abutment normally locks said adjacent coin-dispensing slide against movement, wherein said further abutment moves to unlocked position during said relative movement of said selected one rotatable slide-moving member and of said portion of said adjacent coin-dispensing slide toward each other, wherein said further abutment is on said portion of said adjacent coin-dispensing slide, and wherein a stationary member of said coin-handling device normally receives said further abutment and thereby normally prevents movement of said adjacent coin-dispensing slide.

5. A coin-handling device as claimed in claim 1 wherein said portion of said adjacent coin-dispensing slide is engageable by said abutment on said selected one rotatable slide-moving member to cause said adjacent coin-dispensing slide to move in one direction, wherein an abutment on said adjacent coin-dispensing slide responds to engagement thereof by said abutment on said selected one rotatable slide-moving member to cause said adjacent coin-dispensing slide to move in the opposite direction, and wherein said abutment on said adjacent coin-dispensing slide and said portion of said adjacent coin-dispensing slide are spaced apart a distance which is greater than the width of said abutment on said selected one rotatable slide-moving member, whereby said abutment on said selected one rotatable slide-moving member can be spaced from said portion of said adjacent coin-dispensing slide in the de-energized condition of said electric motor even if said abutment on said selected one rotatable slide-moving member "coasts" beyond the position it should occupy as said electric motor becomes de-energized.

6. A coin-handling device as claimed in claim 1 wherein said portion of said adjacent coin-dispensing slide is engageable by said abutment on said selected one rotatable slide-moving member to cause said adjacent coin-dispensing slide to move in one direction, wherein an abutment on said adjacent coin-dispensing slide responds to engagement thereof by said abutment on said selected one rotatable slide-moving member to cause said adjacent coin-dispensing slide to move in the opposite direction, wherein said abutment on said adjacent coin-dispensing slide and said portion of said adjacent coin-dispensing slide are spaced apart a distance which is greater than the width of said abutment on said selected one rotatable slide-moving member, and wherein said means normally holds said abutment on said selected one rotatable slide-moving member displaced from said portion of said adjacent coin-dispensing slide, whereby said means can provide a short relative movement of said selected one rotatable slide-moving member and of said portion of said adjacent coin-dispensing slide before said abutment on said selected one rotatable slide-moving member engages said portion of said adjacent coin-dispensing slide.

7. A coin-handling device which has a plurality of coin reservoirs, a plurality of coin-dispensing slides that are disposed adjacent to said coin reservoirs and that are movable relative to said coin reservoirs to dispense coins from said coin reservoirs, an electric motor, a plurality of rotatable slide-moving members that are disposed adjacent to said coin reservoirs and to said coin-dispensing slides therefor and that are connected to said electric motor so that all of said rotatable slide-moving members rotate whenever a coin is to be dispensed from any of said coin reservoirs, and means to provide relative movement of a selected one of said rotatable slide-moving members and of a portion of the adjacent coin-dispensing slide toward each other and away from each other, said selected one rotatable slide-moving member being movable with said portion of said adjacent coin-dispensing slide to move said adjacent coin-dispensing slide after said relative movement of said selected one rotatable slide-moving member and of said portion of said adjacent coin-dispensing slide toward each other, a driving element for said selected one rotatable slide-moving member which is intermediate said electric motor and said selected one rotatable slide-moving member, an abutment on said selected one rotatable slide-moving member that is positively forced into direct engagement with said portion of said adjacent coin-dispensing slide to directly move said portion of said adjacent coin-dispensing slide whenever said means provides said relative movement of said selected one rotatable slide-moving member and said portion of said adjacent coin-dispensing slide toward each other, said abutment on said selected one rotatable slide-moving member and said portion of said adjacent coin-dispensing slide being selectively but directly engageable in response to said relative movement of said selected one rotatable slide-moving member and of said portion of said adjacent coin-dispensing slide toward each other and being selectively separable in response to said relative movement of said selected one rotatable slide-moving member and of said portion of said adjacent coin-dispensing slide away from each other, the engagement of said abutment on said selected one rotatable slide-moving member and said portion of said adjacent coin-dispensing slide directly and positively enabling movement of said selected one rotatable slide-moving member to move said adjacent coin-dispensing slide, said abutment on said selected one rotatable slide-moving member, being eccentric of the axis of rotation of said selected one rotatable slide-moving member, and said relative movement of said selected one rotatable slide-moving member and of said portion of said adjacent coin-dispensing slide toward each other and away from each other being along a line which is parallel to said axis of rotation of said selected one rotatable slide-moving member.

8. A coin-handling device which has a plurality of coin reservoirs, a plurality of coin-dispensing slides that are disposed adjacent to said coin reservoirs and that are movable relative to said coin reservoirs to dispense coins from said coin reservoirs, an electric motor, a plurality of rotatable slide-moving members that are disposed adjacent to said coin reservoirs and to said coin-dispensing slides therefor and that are connected to said electric motor so that all of said rotatable slide-moving members rotate whenever a coin is to be dispensed from any of said coin reservoirs, and means to provide relative movement of a selected one of said rotatable slide-moving members and of a portion of the adjacent coin-dispensing slide toward each other and away from each other, said selected one rotatable slide-moving member being movable with said portion of said adjacent coin-dispensing slide to move said adjacent coin-dispensing slide after said relative movement of said selected one rotatable slide-moving member and of said portion of said adjacent coin-dispensing slide toward each other, a driving element for said selected one rotatable slide-moving member which is intermediate said electric motor and said selected one rotatable slide-moving member, an abutment on said selected one rotatable slide-moving member that is positively forced into direct engagement with said portion of said adjacent coin-dispensing slide to directly move said portion of said adjacent coin-dispensing slide whenever said means provides said relative movement of said selected one rotatable slide-moving member and said portion of said adjacent coin-dispensing slide toward each other, said abutment on said selected one rotatable slide-moving member and said portion of said adjacent coin-dispensing slide being selectively but directly engageable in response to said relative movement of said selected one rotatable slide-moving member and of said portion of said adjacent coin-dispensing slide toward each other and being selectively separable in response to said relative movement of said selected one rotatable slide-moving member and of said portion of said adjacent coin-dispensing slide away from each other, the engagement of said abutment on said selected one rotatable slide-moving member and said portion of said adjacent coin-dispensing slide directly and positively enabling movement of said selected one rotatable slide-moving member to move said adjacent coin-dispensing slide, said abutment on said selected one rotatable slide-moving member being a pin which is eccentric of the axis of rotation of said selected one rotatable slide-moving member, and said portion of said adjacent coin-dispensing slide serving as a wall of a recess for said pin on said selected one rotatable slide-moving member.

9. A coin-handling device which has a plurality of coin reservoirs, a plurality of coin-dispensing slides that are disposed adjacent to said coin reservoirs and that are movable relative to said coin reservoirs to dispense coins from said coin reservoirs, an electric motor, a plurality of rotatable slide-moving members that are disposed adjacent to said coin reservoirs and to said coin-dispensing slides therefor and that are connected to said electric motor so that all of said rotatable slide-moving members rotate whenever a coin is to be dispensed from any of said coin reservoirs, and means to provide relative movement of a selected one of said rotatable slide-moving members and of a portion of the adjacent coin-dispensing slide toward each other and away from each other, said selected one rotatable slide-moving member being movable with said portion of said adjacent coin-dispensing slide to move said adjacent coin-dispensing slide after said relative movement of said selected one rotatable slide-moving member and of said portion of said adjacent coin-dispensing slide toward each other, a driving element for said selected one rotatable slide-moving member which is intermediate said electric motor and said selected one rotatable slide-moving member, an abutment on said selected one rotatable slide-moving member that is positively forced into direct engagement with said portion of said adjacent coin-dispensing slide to directly move said portion of said adjacent coin-dispensing slide whenever said means provides said relative movement of said selected one rotatable slide-moving member and said portion of said adjacent coin-dispensing slide toward each other, said abutment on said selected one rotatable slide-moving member and said portion of said adjacent coin-dispensing slide being selectively but directly engageable in response to said relative movement of said selected one rotatable slide-moving member and of said portion of said adjacent coin-dispensing slide toward each other and being selectively separable in response to said relative movement of said selected one rotatable slide-moving member and of said portion of said adjacent coin-dispensing slide away from each other, the engagement of said abutment on said selected one rotatable slide-moving member and said portion of said adjacent coin-dispensing slide directly and positively enabling movement of said selected one rotatable slide-moving member to move said adjacent coin-dispensing slide, said abutment on said selected one rotatable slide-moving member being a pin which is eccentric of the axis of rotation of said selected one rotatable slide-moving member, and said portion of said adjacent coin-dispensing slide serving as a wall of a recess for said pin on said selected one rotatable slide-moving member, and said portion of said adjacent coin-dispensing slide having a passage therethrough which permits said pin on said selected one rotatable slide-moving member to respond to rotation of said selected one rotatable slide-moving member to move into said recess, on said adjacent coin-dispensing slide, for said pin on said selected one rotatable slide-moving member.

10. A coin-handling device which has a plurality of coin reservoirs, a plurality of coin-dispensing slides that are disposed adjacent to said coin reservoirs and that are movable relative to said coin reservoirs to dispense coins from said coin reservoirs, an electric motor, a plurality of rotatable slide-moving members that are disposed adjacent to said coin reservoirs and to said coin-dispensing slides therefor and that are connected to said electric motor so that all of said rotatable slide-moving members rotate whenever a coin is to be dispensed from any of said coin reservoirs, and means to provide relative movement of a selected one of said rotatable slide-moving members and of a portion of the adjacent coin-dispensing slide toward each other and away from each other, said selected one rotatable slide-moving member being movable with said portion of said adjacent coin-dispensing slide to move said adjacent coin-dispensing slide after said relative movement of said selected one rotatable slide-moving member and of said portion of said adjacent coin-dispensing slide toward each other, a driving element for said selected one rotatable slide-moving member which is intermediate said electric motor and said selected one rotatable slide-moving member, an abutment of said selected one rotatable slide-moving member that is positively forced into direct engagement with said portion of said adjacent coin-dispensing slide to directly move said portion of said adjacent coin-dispensing slide whenever said means provides said relative movement of said selected one rotatable slide-moving member and said portion of said adjacent coin-dispensing slide toward each other, said abutment on said selected one rotatable slide-moving member and said portion of said adjacent coin-dispensing slide being selectively but directly engageable in response to said relative movement of said selected one rotatable slide-moving member and of said portion of said adjacent coin-dispensing slide toward each other and being selectively separable in response to said relative movement of said selected one rotatable slide-moving member and of said portion of said adjacent coin-dispensing slide away from each other, the engagement of said abutment on said selected one rotatable slide-moving member and said portion of said adjacent coin-dispensing slide directly and positively enabling movement of said selected one rotatable slide-moving member to move said adjacent coin-dispensing slide, said abutment on said selected one rotatable slide-moving member being eccentric of the axis of rotation of said selected one rotatable slide-moving member, said relative movement of said selected one rotatable slide-moving member and of said portion of said adjacent coin-dispensing slide toward each other and away from each other being along a line which is parallel to said axis of rotation of said selected one rotatable slide-moving member, said abutment on said selected one rotatable slide-moving member being a pin, and said portion of said adjacent coin-dispending slide serving as a wall of a recess for said pin on said selected one rotatable slide-moving member.

11. A coin-handling device which has a plurality of coin reservoirs, a plurality of coin-dispensing slides that are disposed adjacent to said coin reservoirs and that are movable relative to said coin reservoirs to dispense coins from said coin reservoirs, an electric motor, a plurality of rotatable slide-moving members that are disposed adjacent to said coin reservoirs and to said coin-dispensing slides therefor and that are connected to said electric motor so that all of said rotatable slide-moving members rotate whenever a coin is to be dispensed from any of said coin reservoirs, and means to provide relative movement of a selected one of said rotatable slide-moving members and of a portion of the adjacent coin-dispensing slide toward each other and away from each other, said selected one rotatable slide-moving member being movable with said portion of said adjacent coin-dispensing slide to move said adjacent coin-dispensing slide after said relative movement of said selected one rotatable slide-moving member and of said portion of said adjacent coin-dispensing slide toward each other, a driving element for said selected one rotatable slide-moving member which is intermediate said electric motor and said selected one rotatable slide-moving member, an abutment of said selected one rotatable slide-moving member that is positively forced into direct engagement with said portion of said adjacent coin-dispensing slide to directly move said portion of said adjacent coin-dispensing slide whenever said means provides said relative movement of said selected one rotatable slide-moving member and said portion of said adjacent coin-dispensing slide toward each other, said abutment on said selected one rotatable slide-moving member and said portion of said adjacent coin-dispensing slide being selectively but directly engageable in response to said relative movement of said selected one rotatable slide-moving member and of said portion of said adjacent coin-dispensing slide toward each other and being selectively separable in response to said relative movement of said selected one rotatable slide-moving member and of said portion of said adjacent coin-dispensing slide away from each other, the engagement of said abutment on said selected one rotatable slide-moving member and said portion of said adjacent coin-dispensing slide directly and positively enabling movement of said selected one rotatable slide-moving member to move said adjacent coin-dispensing slide, said abutment on said selected one rotatable slide-moving member being eccentric of the axis of rotation of said selected one rotatable slide-moving member, said relative movement of said selected one rotatable slide-moving member and of said portion of said adjacent coin-dispensing slide toward each other and away from each other being along a line which is parallel to said axis of rotation of said selected one rotatable slide-moving member, said abutment on said selected one rotatable slide-moving member being a pin, said portion of said adjacent coin-dispensing slide serving as a wall of a recess for said pin on said member, and said portion of said adjacent coin-dispensing slide having a passage therethrough which permits said pin on said selected one rotatable slide-moving member to respond to rotation of said selected one rotatable slide-moving member to move into said recess for said pin on said selected one rotatable slide-moving member.

12. A coin-handling device which has a plurality of coin reservoirs, a plurality of coin-dispensing slides that are disposed so each of said coin-dispensing slides is adjacent to and movable relative to a coin reservoir to dispense a coin from said coin reservoir, an electric motor, a plurality of gears that are disposed so each of said coin-dispensing slides has a gear adjacent to it to selectively drive it, said electric motor constituting a driving element for said gears and said electric motor driving all of said gears whenever a coin is to be dispensed from any of said coin reservoirs, means to selectively interconnect any one of said gears with the coin-dispensing slide therefor to enable said one gear to drive said coin-dispensing slide therefor while simultaneously permitting another of said gears to remain independent of the coin-dispensing slide therefor, whereby said coin-handling device can effect the dispensing of coins from the coin reservoir adjacent said one coin-dispensing slide while permitting no coins to be dispensed from the coin reservoir adjacent said other coin-dispensing slide, a plurality of driving surfaces that rotate whenever said gears rotate and that are selectively but positively forced into direct engagement with portions of adjacent coin-dispensing slides to directly move said adjacent coin-dispensing slides, said means selectively causing a selected one of said plurality of driving surfaces to be forced into direct engagement with said portion of the adjacent coin-dispensing slide to enable said selected one of said plurality of driving surfaces to drive said adjacent coin-dispensing slide relative to the coin reservoir adjacent thereto, the selective engagement of said selected one of said driving surfaces with said portion of said adjacent coin-dispensing slide directly and positively enabling movement of said selected one of said plurality of driving surfaces to move said adjacent coin-dispensing slide.

13. A coin-handling device as claimed in claim 12 wherein said gears rotate about axes of rotation, wherein said plurality of driving surfaces are on said gears, and wherein said means causes relative movement of the driving surface on one of said gears and a portion of the adjacent coin-dispensing slide therefor along a line parallel to the axis of rotation of said one of said gears.

14. A coin-handling device which has a support, a plurality of coin reservoirs mounted on said support, a plurality of coin-dispensing slides that are slidably mounted on said support and that are disposed so each of said coin-dispensing slides is adjacent to and movable relative to a coin reservoir to dispense a coin from said coin reservoir, a plurality of members that are rotatably mounted on said support and that are disposed so each of said coin-dispensing slides has a rotatably-mounted member adjacent to it to selectively drive it, an electric motor which rotates all of said rotatably-mounted members whenever any of said coin-dispensing slides is to be moved relative to the coin reservoir adjacent thereto to dispense a coin from said adjacent coin reservoir, and means to selectively interconnect any one of said rotatably-mounted members with the coin-dispensing slide therefor to enable said one rotatably-mounted member to drive said coin-dispensing slide therefor, said support and said plurality of coin reservoirs and said plurality of coin-dispensing slides and said plurality of rotatably-mounted members and said means constituting a sub-assembly which can be handled and transported as a unit and which can be mounted in, and which can constitute a unitary part of, a coin-dispensing machine, said means including an abutment on said one rotatably-mounted member and also including an abutment on said coin-dispensing slide therefor, said abutments being directly engageable to cause rotation of said one rotatably-mounted member to drive said coin-dispensing slide therefor.

15. A coin-handling device which comprises a plurality of coin reservoirs, a plurality of coin-dispensing slides that are disposed so each of said coin-dispensing slides is adjacent a coin reservoir and is movable relative to said adjacent coin reservoir to dispense a coin from said adjacent coin reservoir, an electric motor, a plurality of slide-moving gears which are disposed adjacent to said coin reservoirs and to said coin-dispensing slides therefor and which are disposed so each of said coin-dispensing slides has a slide-moving gear adjacent to it, said electric motor constituting a driving element for said coin-dispensing slides, and means to selectively interconnect one of said slide-moving gears with the coin-dispensing slide therefor to enable said one slide-moving gear to drive said coin-dispensing slide when said one slide-moving gear moves by providing relative movement of a portion of said one slide-moving gear and a portion of said one coin-dispensing slide toward each other, said portion of said one slide-moving gear serving as an abutment, said portion of said one coin-dispensing slide also serving as an abutment, said abutments being directly engageable to cause rotation of said one slide-moving gear to drive said one coin-dispensing slide.

* * * * *